US009196995B2

(12) United States Patent
Scanzillo

(10) Patent No.: US 9,196,995 B2
(45) **Date of Patent: *Nov. 24, 2015**

(54) TAMPER RESISTANT MECHANISM FOR 15 AND 20 AMP ELECTRICAL RECEPTACLES

(71) Applicant: Hubbell Incorporated, Shelton, CT (US)

(72) Inventor: Thomas L. Scanzillo, Monroe, CT (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/134,851

(22) Filed: Dec. 19, 2013

(65) Prior Publication Data

US 2015/0180154 A1 Jun. 25, 2015

(51) Int. Cl.
*H01R 13/44* (2006.01)
*H01R 13/453* (2006.01)

(52) U.S. Cl.
CPC ..... *H01R 13/453* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,990,758 | A | | 11/1976 | Petterson |
| 5,020,997 | A | | 6/1991 | Calderara et al. |
| 5,095,182 | A | | 3/1992 | Thompson |
| 5,244,398 | A | | 9/1993 | Chou |
| 5,267,870 | A | | 12/1993 | Maresh |
| 5,277,602 | A | | 1/1994 | Yi |
| 5,281,156 | A | | 1/1994 | Yi |
| 5,320,545 | A | | 6/1994 | Brothers |
| 5,915,981 | A | * | 6/1999 | Mehta ..... 439/137 |
| 5,998,735 | A | | 12/1999 | Patterson, Jr. |
| 6,056,564 | A | | 5/2000 | Huang |
| 6,086,391 | A | | 7/2000 | Chiu |
| 6,111,210 | A | | 8/2000 | Allison |
| 6,217,353 | B1 | | 4/2001 | Yu-Tse |
| 6,229,107 | B1 | | 5/2001 | Flint et al. |
| 6,238,224 | B1 | | 5/2001 | Shao |
| 6,422,880 | B1 | | 7/2002 | Chiu |
| 6,537,088 | B2 | | 3/2003 | Huang |
| 6,555,771 | B2 | | 4/2003 | Shao |
| 6,776,630 | B1 | | 8/2004 | Huang |
| 6,786,745 | B1 | | 9/2004 | Huang |
| 6,893,275 | B2 | | 5/2005 | Ng et al. |
| 6,932,631 | B2 | | 8/2005 | Huang |
| 7,114,968 | B2 | | 10/2006 | Healy |
| 7,179,992 | B1 | | 2/2007 | Packard et al. |
| 7,214,101 | B1 | | 5/2007 | Tong et al. |

(Continued)

*Primary Examiner* — Jean F Duverne
(74) *Attorney, Agent, or Firm* — Dickinson Wright PLLC

(57) ABSTRACT

A tamper resistant shutter assembly for an electrical device includes a housing. A first shutter member is movably disposed in the housing between closed and open positions. A second shutter member is movably disposed in the housing between closed and open positions. A third shutter member is movably disposed in the housing between closed and open positions. The third shutter member is movable from the closed position to the open position by movement of the second shutter member from the closed position to the open position. A fourth shutter member is movably disposed in the housing between closed and open positions. The fourth shutter member is movable from the closed position to the open position by movement of the first shutter member from the closed position to the open position. A fifth shutter member is movably disposed in the housing between closed and open positions. The fifth shutter member is prevented from moving from the closed position to the open position when the fourth shutter member is in the closed position.

20 Claims, 15 Drawing Sheets

(56) References Cited

U.S. PATENT DOCUMENTS

| | | | | |
|---|---|---|---|---|
| 7,312,394 | B1 | 12/2007 | Weeks et al. | |
| 7,312,963 | B1 | 12/2007 | Radosavljevic et al. | |
| 7,355,117 | B2 | 4/2008 | Castaldo et al. | |
| 7,438,567 | B2 | 10/2008 | Nalwad et al. | |
| 7,452,221 | B1 | 11/2008 | Oddsen et al. | |
| 7,455,538 | B2 | 11/2008 | Germain | |
| 7,510,412 | B1 | 3/2009 | Valentin | |
| 7,527,508 | B1 | 5/2009 | Lee et al. | |
| 7,551,047 | B2 | 6/2009 | Sokolow et al. | |
| 7,556,513 | B2 | 7/2009 | Ng et al. | |
| 7,588,447 | B1 | 9/2009 | Ni | |
| 7,595,449 | B1 | 9/2009 | Dyderski | |
| 7,637,756 | B1 | 12/2009 | Hsu | |
| 7,642,457 | B2 | 1/2010 | Weeks et al. | |
| 7,645,148 | B2 | 1/2010 | Carbone et al. | |
| 7,645,149 | B2 | 1/2010 | Carbone et al. | |
| 7,651,347 | B2 | 1/2010 | Germain et al. | |
| 7,883,346 | B2 | 2/2011 | Huang | |
| 8,672,695 | B2 * | 3/2014 | Baldwin et al. | 439/137 |
| 2008/0156512 | A1 | 7/2008 | Castaldo et al. | |
| 2008/0248662 | A1 | 10/2008 | Bazayev et al. | |
| 2009/0023304 | A1 | 1/2009 | Gerard | |
| 2009/0236115 | A1 | 9/2009 | Li | |
| 2009/0286411 | A1 | 11/2009 | Bazayev et al. | |
| 2009/0311892 | A1 | 12/2009 | Weeks | |
| 2010/0041259 | A1 | 2/2010 | Ni | |
| 2010/0130053 | A1 | 5/2010 | Ziobro | |
| 2011/0136358 | A1 | 6/2011 | Zhang | |

* cited by examiner

TAMPER RESISTANT MECHANISM FOR 15 AND 20 AMP ELECTRICAL RECEPTACLES

CROSS REFERENCE TO RELATED APPLICATIONS

This application is related to U.S. patent application Ser. No. 14/039,943 to Baldwin et al. entitled "Electrical Cord with Tamper Resistant Mechanism" which was filed on Sep. 27, 2013, which is a continuation of U.S. patent application Ser. No. 13/912,348 to Baldwin et al. entitled "Electrical Cord With Tamper Resistant Mechanism" which was filed on Jun. 7, 2013, which is a continuation of U.S. patent application Ser. No. 13/482,101 to Baldwin et al. entitled "Electrical Cord With Tamper Resistent Mechanism" which was filed on May 29, 2012, which is a continuation of U.S. patent application Ser. No. 13/274,934 to Baldwin et al. entitled "Electrical Cord with Tamper Resistent Mechanism", which was filed on Oct. 17, 2011, which application was a continuation-in-part of U.S. patent application Ser. No. 13/050,777 to Baldwin et al. entitled "Tamper Resistant Electrical Device", which was filed on Mar. 17, 2011, which application claimed the benefit of U.S. Provisional Patent Application 61/315,368 to Baldwin et al. entitled "Tamper Resistant Receptacles", which was filed on Mar. 18, 2010, and U.S. Provisional Patent Application 61/389,612 to Cleghorn et al. entitled "Tamper Resistant Shutters for an Electrical Device" which was filed on Oct. 4, 2010, the entire disclosures of which are hereby incorporated herein by reference.

FIELD OF THE INVENTION

Aspects of the present disclosure relate to electrical receptacles and electrical cords that selectively prevent and permit objects to engage electrical contacts within the receptacle and electrical cord to reduce the risk of electrocution.

BACKGROUND OF THE INVENTION

Electrical devices, and specifically electrical receptacles capable of receiving electrical plugs to provide electricity to the electrical plug are well known. In the United States, electrical receptacles generally include two or three prongs, with each set arranged to receive an electrical plug. Electrical receptacles, with the exception of Ground Fault Circuit Interrupters (GFCI) are generally always active, meaning they provide electricity to the electrical receptacle contacts at all times. GFCI devices function similarly, except they can restrict electrical current in the event that a short or current imbalance is detected in the circuit. After a fault is detected, the GFCI cuts off power to the electrical receptacle contacts until a user resets the GFCI.

Nevertheless, children in particular are susceptible to being shocked in the event that the child inserts a conductive object into an electrical receptacle opening. Conductive objects may include knives, paper clips, screw drivers, or the like that a child inserts into the opening and receives an electrical shock, electrocution, or a burn. One attempt to alleviate the potential for electrocution has been to incorporate doors in the electrical device that must be overcome before the object can reach the electrical contacts. Each of these attempts includes complex mechanisms which are unnecessary or difficult to manufacture. Other attempts may be less complex, but are very cumbersome to operate or are inefficient. Finally, some tamper resistant electrical devices wear out quickly and no longer protect the consumer, and particularly children, from electrical shock hazards.

Electrical cords have long been a danger when plugged into an active outlet. Once the electrical cord is connected to an active receptacle, a child may be injured by inserting a conductive object into the opposite end of the electrical cord that is free.

SUMMARY OF THE INVENTION

This disclosure includes one or more electrical devices and electrical cords with tamper resistant members to substantially prevent access to the electrical terminals by unauthorized articles.

A particular aspect broadly includes an electrical cord including a plug on a first end and at least one socket on a second end opposite the first end, a protective shutter assembly disposed within the at least one socket, the shutter assembly including a first shutter member and a second shutter member each positioned proximate the cover assembly and each of the first and second shutter members is at least partially aligned with separate cover openings in the cover assembly and being configured to move from a closed position to an open position in response to engaging a plug blade, a third shutter member positioned behind the first shutter member, a fourth shutter member positioned behind the second shutter member, and wherein the first, second, third, and fourth shutter members are each separate components.

In particular implementations, the first shutter member may be pivotally connected to the fourth shutter member and the second shutter member may be pivotally connected to the third shutter member. The first and second shutter members may be pivotally moved from the closed position to the open position in response to engagement by the plug blade. The third and fourth shutter members may be linearly moved from the closed position to the open position in response to engagement by the plug blade. The first and second shutter members may pivot in the same direction from the closed position to the open position. The first and second shutter members may pivot in opposite directions from the closed position to the open position.

In additional particular implementations, the first shutter member may pivot from the closed position to the open position in response to engaging the plug blade and the fourth shutter member may be linearly moved from the closed position to the open position by the pivotal movement of the first shutter member. The second shutter member may pivot from the closed position to the open position in response to engaging the plug blade and the third shutter member may be linearly moved from the closed position to the open position by the pivotal movement of the second shutter member. The third and fourth shutter members may be biased into the closed position with a spring.

The first, second, third, and fourth shutter members may each further include an engagement portion with a radius. The first shutter member engagement portion may contact the fourth shutter member engagement portion during operation and the second shutter member engagement portion may contact the third shutter member engagement portion during operation. The shutter assembly may also include a first stop limiting linear movement of the third shutter member in a closing direction and a second stop limiting linear movement of the fourth shutter member in a closing direction. The first and second shutter members may pivot in the direction of the plug blade insertion.

The electrical cord may be an extension cord. The at least one socket may be a plurality of non-movable sockets forming a power strip. The power strip may be surge protected. The at least one socket is a plurality of flexible sockets having independent mobility from one another. The at least one socket is selected from the group consisting of three sockets, four sockets, five sockets, six sockets, seven sockets, and eight sockets.

A particular aspect may broadly include an electrical cord including a plug on a first end and a plurality of sockets with a cover having a plurality of openings on a second end opposite the first end, a protective shutter assembly disposed within each of the plurality of sockets, each of the shutter assemblies including a first shutter member and second shutter member positioned proximate the cover and each of the first and second shutter members is at least partially aligned with separate cover openings in the cover and configured to move from a closed position to an open position in response to engaging at least one plug blade, a third shutter member positioned behind the first shutter member, a fourth shutter member positioned behind the second shutter member, and wherein the first and second shutter members pivot from the closed position to the open position and the third and fourth shutter members slide from the closed position to the closed position to the open position.

In particular implementations, the fourth shutter member is slid from the closed position to the open position by the first shutter member pivoting from the closed position to the open position and the third shutter member is slid from the closed position to the open position by the second shutter member pivoting from the closed position to the open position. The first and second shutter members pivot in opposite directions and the third and fourth shutter members slide in opposite directions. The electrical cord may be a power strip and the pluralities of sockets are rigidly mounted on the second end. The electrical cord is a power strip and the plurality of sockets are flexibly mounted on the second end.

A particular aspect may broadly comprise an electrical cord including a plug on a first end and at least one socket on a second end opposite the first end, a protective shutter assembly disposed within the at least one socket and adjacent electrical contacts within the at least one socket, and wherein the protective shutter assembly permits an electrical plug to contact the electrical contacts and prevents a non-electrical plug from contacting the electrical contacts.

The foregoing objectives are basically attained by a tamper resistant shutter assembly for an electrical device including a housing. A first shutter member is movably disposed in the housing between closed and open positions. A second shutter member is movably disposed in the housing between closed and open positions. A third shutter member is movably disposed in the housing between closed and open positions. The third shutter member is movable from the closed position to the open position by movement of the second shutter member from the closed position to the open position. A fourth shutter member is movably disposed in the housing between closed and open positions. The fourth shutter member is movable from the closed position to the open position by movement of the first shutter member from the closed position to the open position. A fifth shutter member is movably disposed in the housing between closed and open positions. The fifth shutter member is prevented from moving from the closed position to the open position when the fourth shutter member is in the closed position.

The foregoing objectives are also basically attained by a tamper resistant shutter assembly for an electrical device including a housing. A first shutter member is pivotally disposed in the housing between closed and open positions. A second shutter member is pivotally disposed in the housing between closed and open positions. A third shutter member is slidably disposed in the housing between closed and open positions. The third shutter member is slid from the closed position to the open position by pivotal movement of the second shutter member from the closed position to the open position. A first biasing member biases the third shutter member to the closed position. A fourth shutter member is slidably disposed in the housing between closed and open positions. The fourth shutter member is slid from the closed position to the open position by pivotal movement of the first shutter member from the closed position to the open position. A second biasing member biases the fourth shutter member to the closed position. The first and second biasing members are disposed on opposite sides of the first shutter member. A fifth shutter member is slidably disposed in the housing between closed and open positions. The fifth shutter member is prevented from moving from the closed position to the open position when the fourth shutter member is in the closed position. A third biasing member biases the fifth shutter member to the closed position.

Objects, advantages, and salient features of the invention will become apparent from the following detailed description, which, taken in conjunction with the annexed drawings, discloses exemplary embodiments of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which.

Throughout the drawings, like reference numerals will be understood to refer to like parts, components and structures.

DETAILED DESCRIPTION OF EXEMPLARY EMBODIMENTS

Figure 1:
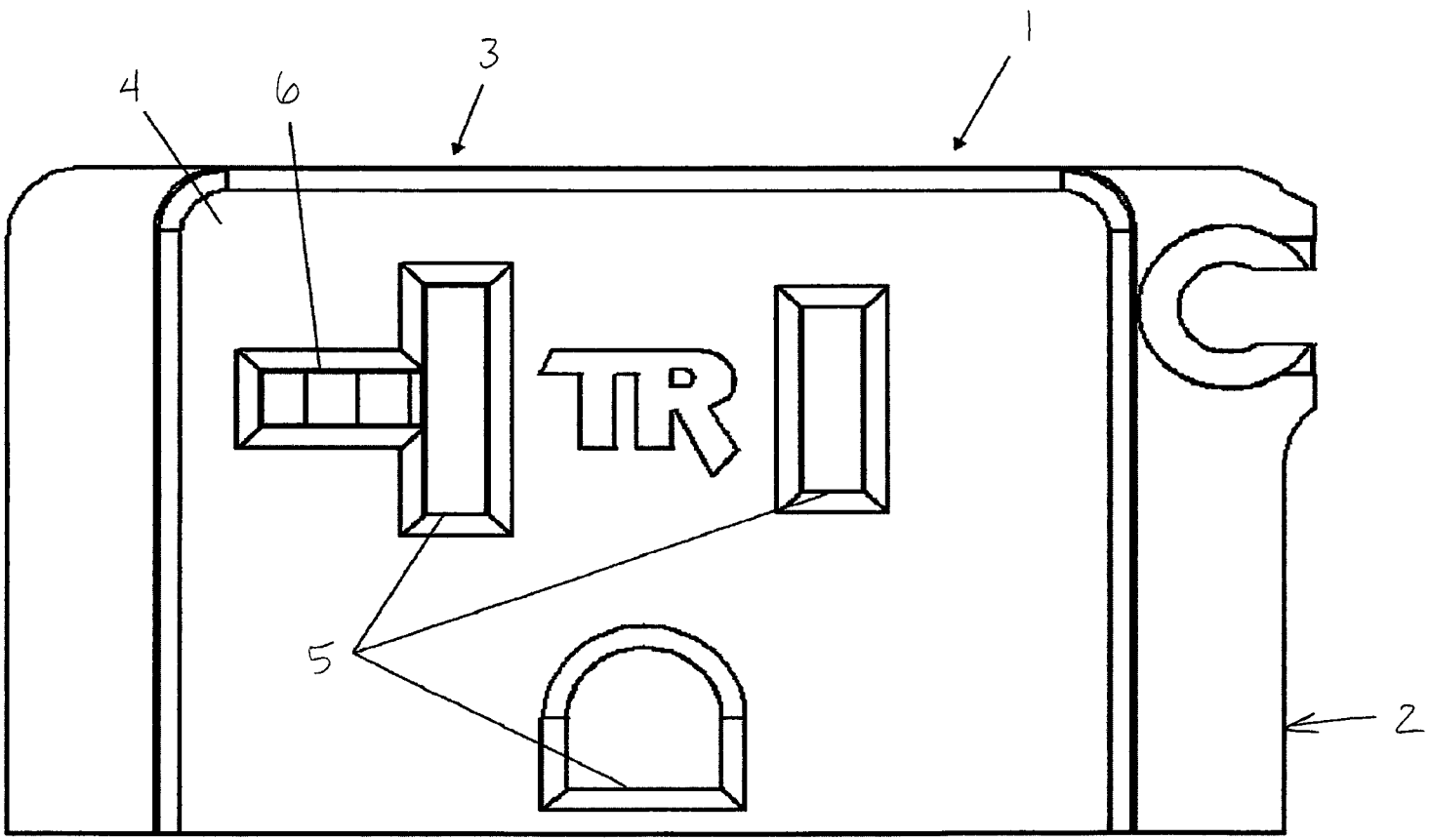
FIG. 1 is a partial front elevational view of a 20 amp tamper resistant electrical face in accordance with a first exemplary embodiment of the present invention in which a tamper resistant shutter assembly is in a closed position.
Figure 2:
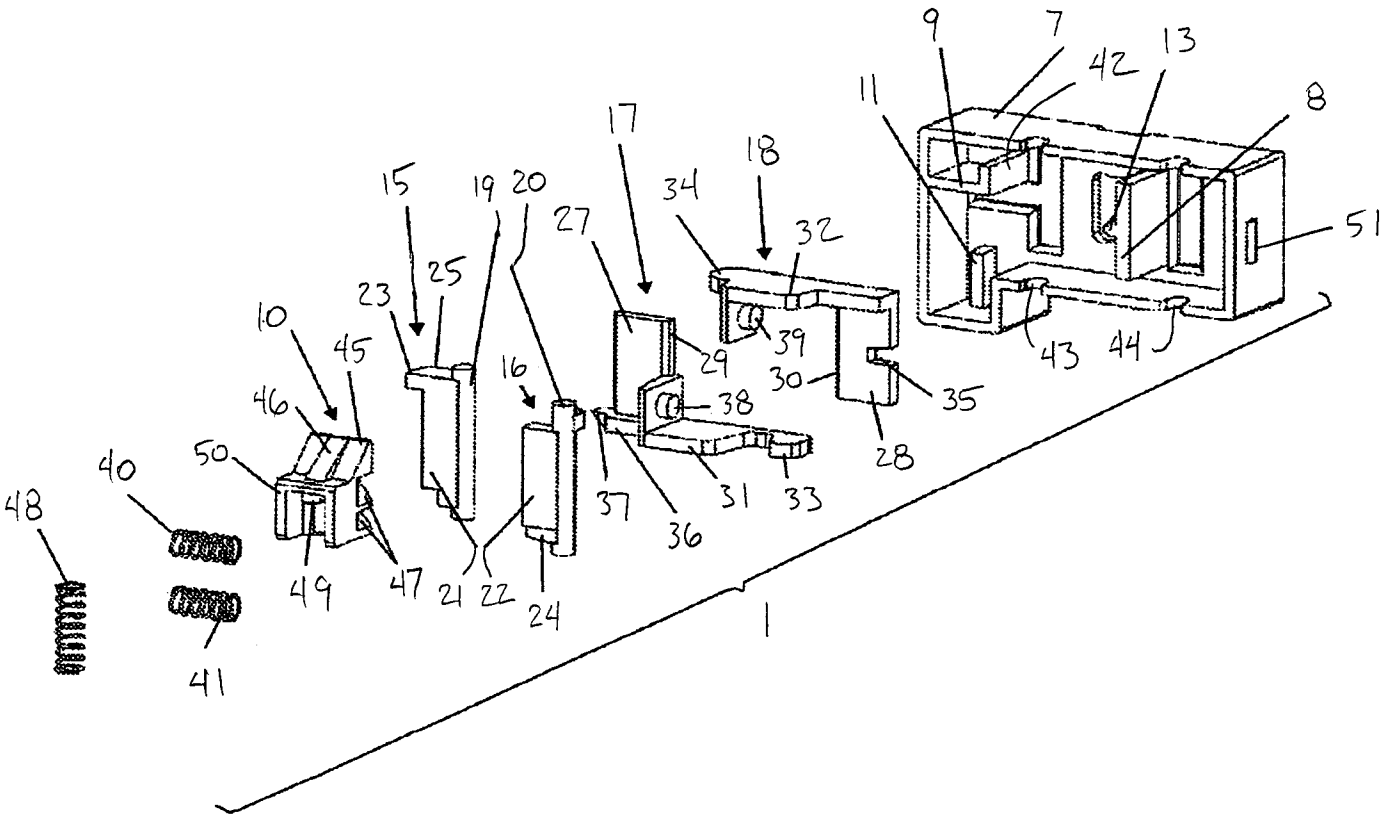
FIG. 2 is an exploded assembly view of the tamper resistant shutter assembly of FIG. 1.

A tamper resistant shutter assembly in accordance with a first exemplary embodiment of the present invention is shown in FIGS. 1-7. The tamper resistant shutter assembly substantially prevents access to the electrical terminals of an electrical device by unauthorized articles.

FIGS. 1 through 7 illustrate a tamper resistant shutter assembly 1 for an electrical device 2 in accordance with a first exemplary embodiment of the present invention. The electrical device 2 has a front face 3 having a front surface 4, openings 5, and a perpendicular prong opening 6. The plurality of openings 5 extend through the front surface 4 to permit electrical plug prongs to engage electrical contacts disposed in the electrical device 2. The electrical contacts are aligned with the openings 56 to ensure that the electrical plug prongs can engage the electrical contacts during normal operation, but the electrical contacts are generally protected from inadvertent engagement. The electrical device is substantially similar to a standard electrical device, such as the electrical receptacle disclosed in U.S. Pat. No. 7,510,412 to Valentin, which is hereby incorporated by reference in its entirety.

Figure 3:
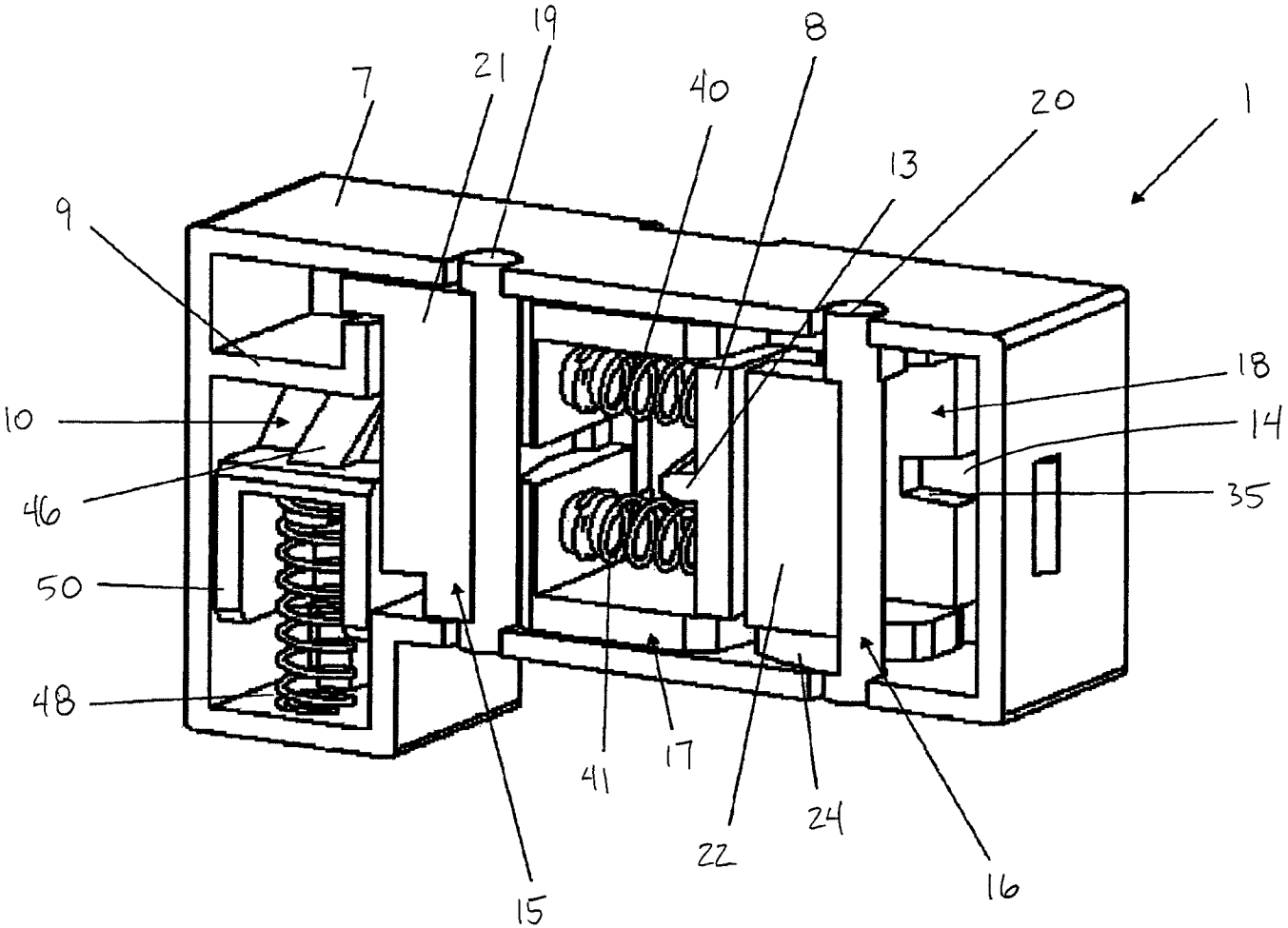
FIG. 3 is an assembled front perspective view of the tamper resistant shutter assembly of FIG. 2 in the closed position.
Figure 4:
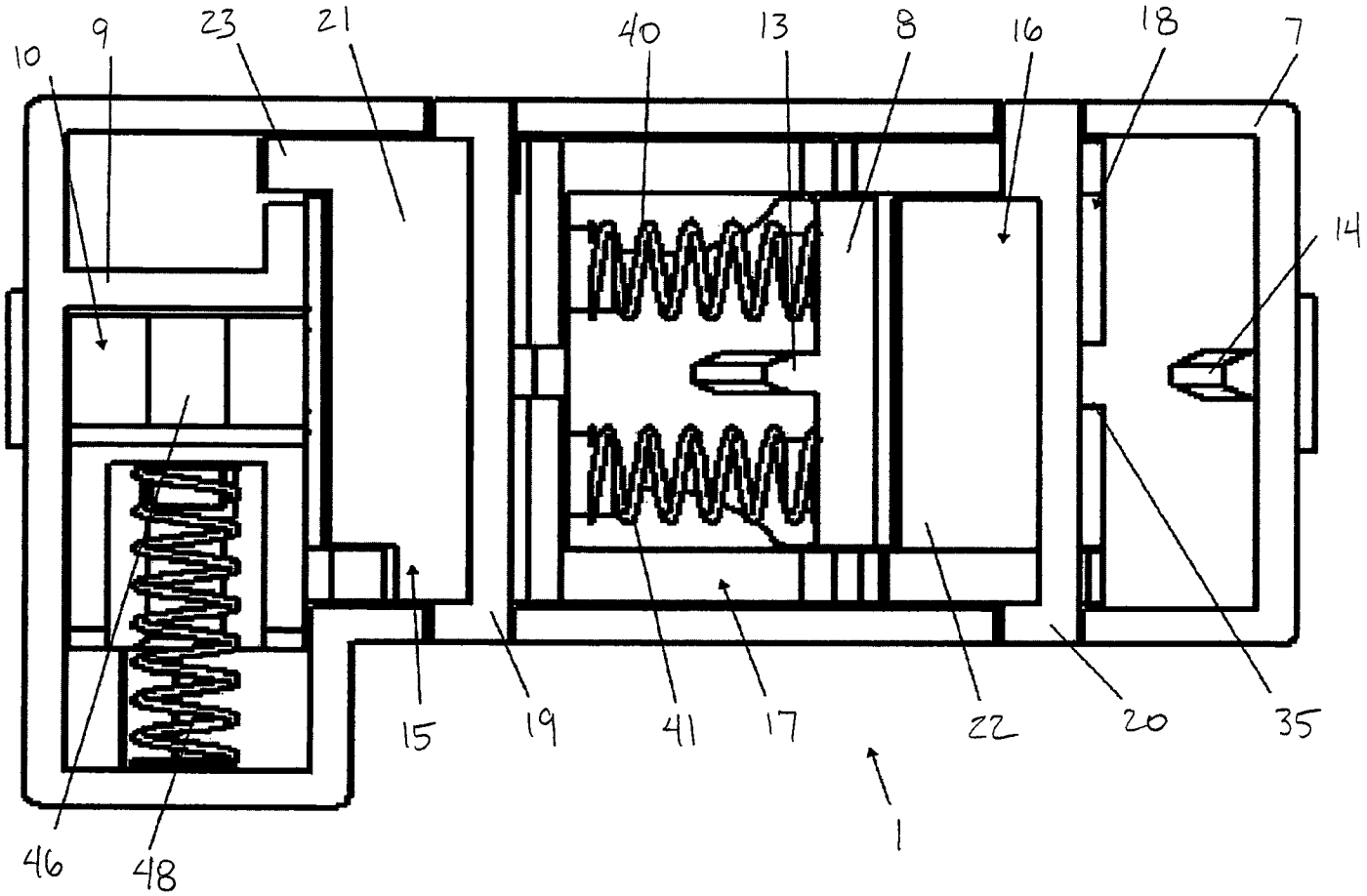
FIG. 4 is a front elevational view of the tamper resistant shutter assembly of FIG. 3 in the closed position.
Figure 5:
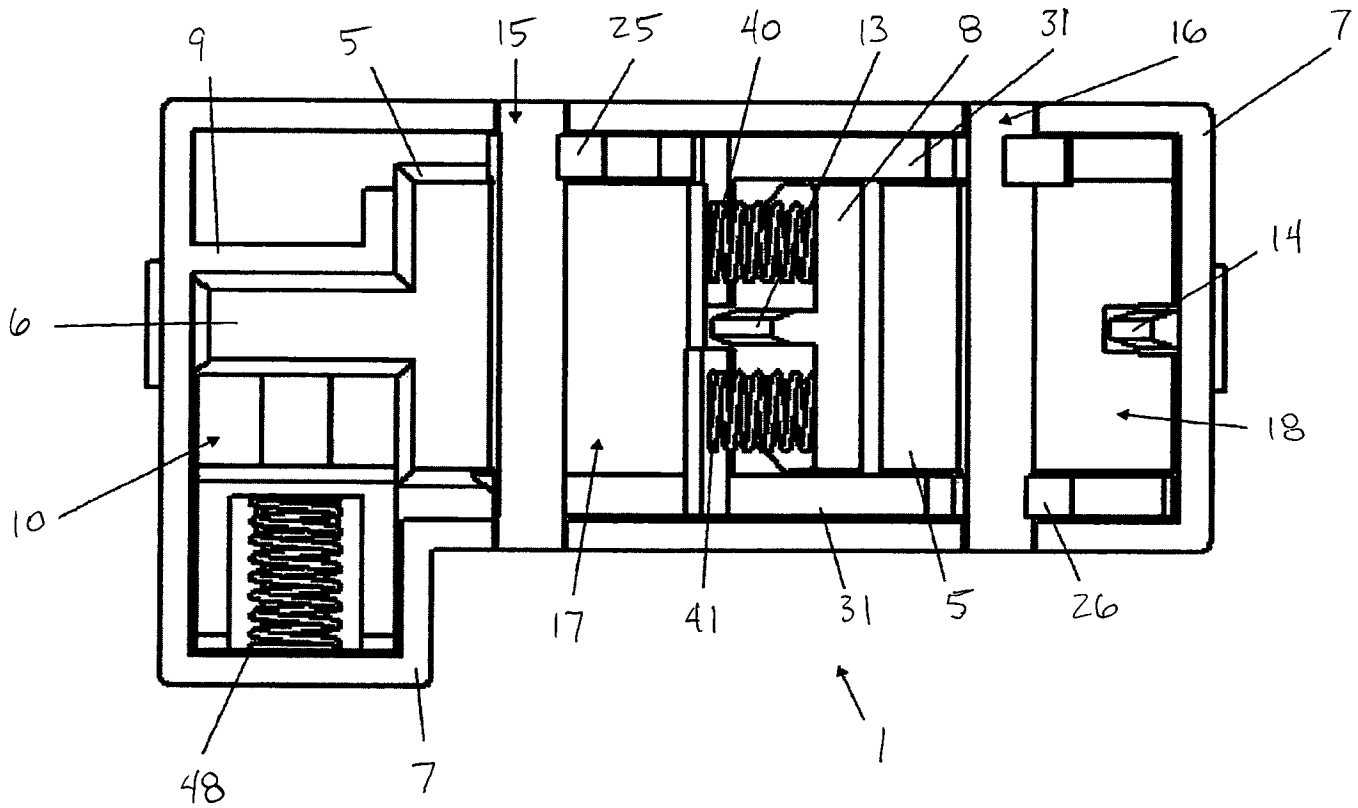
FIG. 5 is a front elevational view of the tamper resistant shutter assembly of FIG. 2 in the open position.
Figure 6:
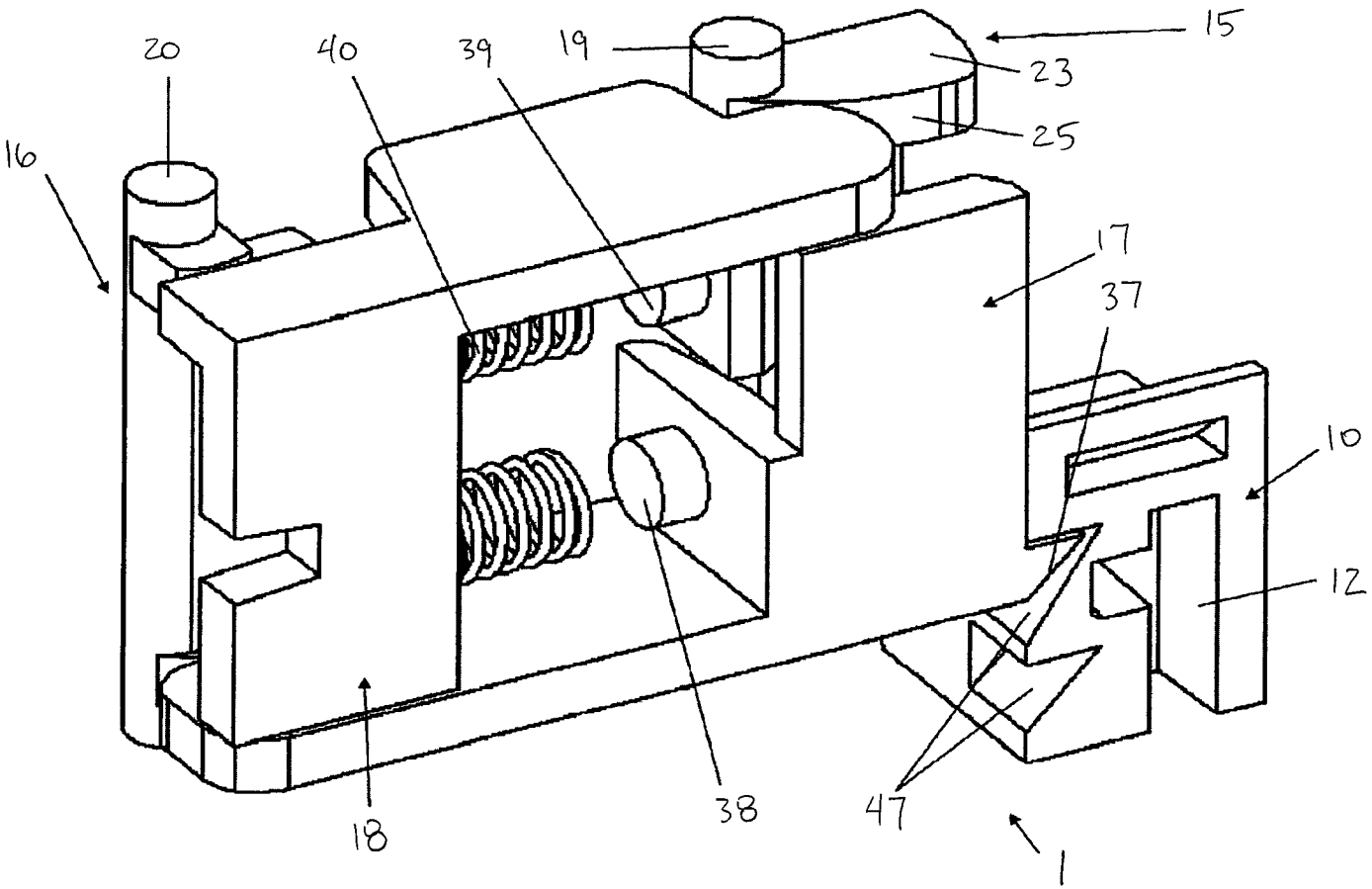
FIG. 6 is a front perspective view of components of the tamper resistant shutter assembly and the locking mechanism of a perpendicular prong shutter in the closed position.
Figure 7:
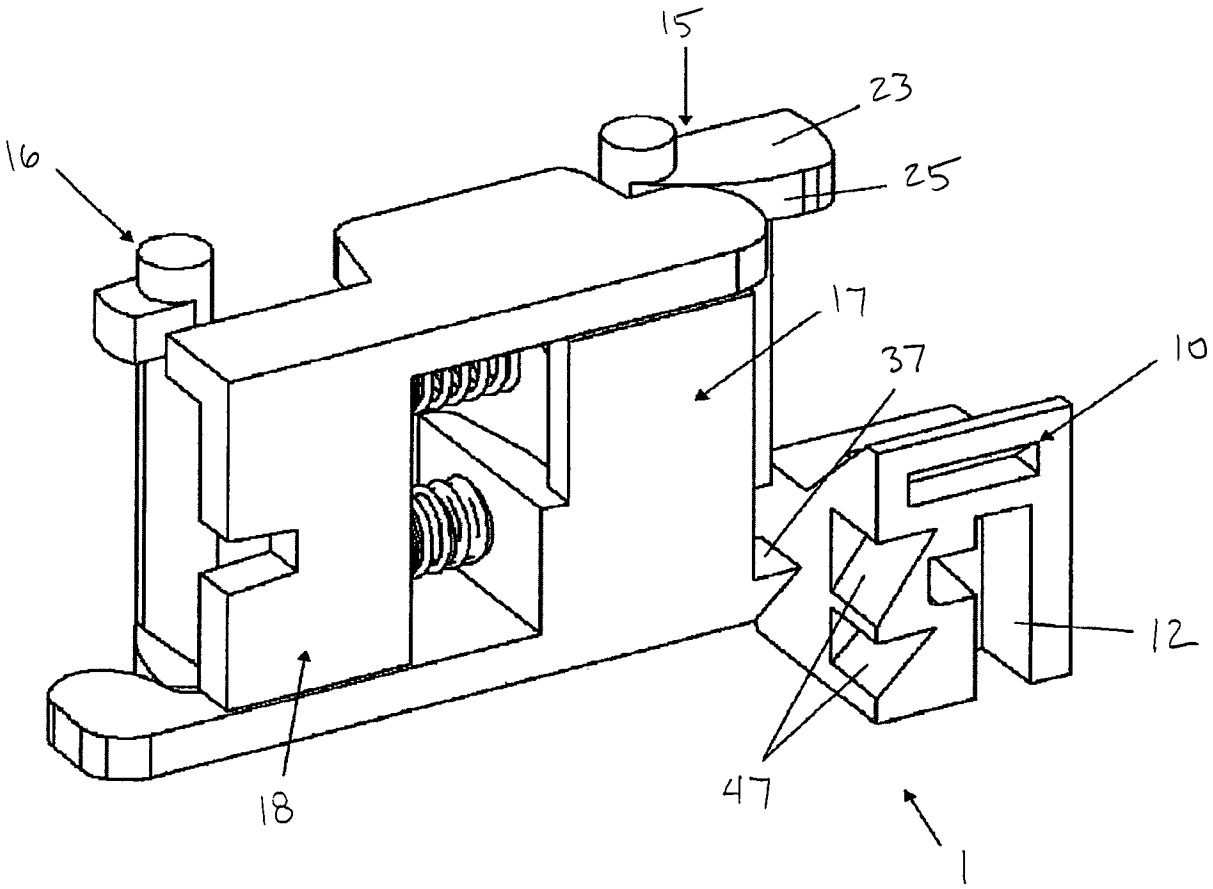
FIG. 7 is a front perspective view of components of the tamper resistant shutter assembly and the locking mechanism of a perpendicular prong shutter in the open position.

Referring to FIGS. 4 and 5, the tamper resistant shutter assembly 1 is shown in the closed position and open position, respectively. As shown in FIG. 4, the tamper resistant shutter assembly 1 prevents an inserted foreign object from accessing an electrical contact disposed in the electrical device. As shown in FIG. 5, an inserted electrical plug has properly engaged the tamper resistant assembly 1 to engage the electrical contacts. In an assembled state, as shown in FIG. 3, a housing 7 of the tamper resistant shutter assembly 1 is shaped and sized to be disposed behind the device front face 3. A pair of mounting tabs 51 may be disposed on opposite sides of the housing 7 to facilitate securing the tamper resistant shutter assembly to the electrical device 2.

The tamper resistant shutter assembly 1 includes a housing 7 with a first stop wall or member 8 limiting travel of the shutter members and a second stop 9 generally perpendicular to the first stop to limit the travel of a perpendicular prong shutter member 10. The housing 7 may also include a perpendicular prong shutter guide 11 extending from the shutter and arranged to mate with a slot 12 (FIG. 6) in the perpendicular prong shutter 10. A first divider 13 may extend from the first stop 8 to separate first and second springs 40 and 41 and a second divider 14 (FIG. 3) may extend inwardly from the housing 7 to assist in locating a lower shutter during operation (described in greater detail below).

A first shutter member 15 is rotatably mounted within a first pair of grooves 43 on a left side of the housing 7, and a second shutter member 16 is rotatably mounted within a pair of grooves 44 on a right side of the housing 7. Each of the first and second shutter members 15 and 16 includes a pivot shoulder 19 and 20 extending from each side of the shutter member. The pivot shoulders 19 and 20 are received by the grooves 43 and 44 to provide rotational movement with minimal friction. Both the first and second shutter members 15 and 16 rotate in the same direction, clockwise as shown in FIG. 3, although the first and second shutter members can rotate in opposite directions.

A third shutter member 17 is disposed behind the first shutter 15, and a fourth shutter member 18 is disposed behind the second shutter member 16. Each of the third and fourth shutter members 17 and 18 has a protrusion 38 and 39 to receive first and second spring members 40 and 41. The first and second spring members 40 and 41 extend between the third and fourth shutter members 17 and 18 and a first stop member 8. A divider 13 on the first stop member 8 facilitates locating and maintaining the location of the spring members 40 and 41 on the first stop member 8. The spring members 40 and 41 are shown as being compression or coil springs, although any suitable biasing member can be used.

The tamper resistant shutter assembly 1 includes four shutter members, with a first shutter member 15 and a second shutter member 16 acting as upper shutter members and a third shutter member 17 and a fourth shutter member 18 acting as lower shutter members. The first and second shutter members 15 and 16 pivot from the closed position to the open position about pivot shoulders 19 and 20. The upper shutter members 15 and 16 can pivot in the same direction and push/pull the lower shutter members in the same direction. The upper shutter member of one side operates the lower shutter member on the opposite side. Further, each of the upper shutter members 15 and 16 includes a blocking surface 21 and 22, a finger 23 and 24, and a rounded engagement portion 25 and 26.

The lower shutter members 17 and 18 each include a blocking ledge 27 and 28 with a tapered end 29 and 30, a guide 31 and 32, and an arm 33 and 34 arranged to contact the respective upper shutter member 15 and 16 during opening and closing. The fourth shutter member 18 may also include an alignment notch 35 arranged to align with the second divider 14 during operation. Further, the third shutter member 17 may include a locking arm 36 with a locking ledge 37 that interacts with the fifth, or perpendicular, prong shutter member 10 as will be discussed in greater detail below. Finally, each of the lower shutter members 15 and 16 includes a spring mount 38 and 39 arranged to hold a spring member 40 and 41 and biasing the lower shutter members 15 and 16 into the closed position, thereby also biasing the upper shutter members 17 and 18 into the closed position.

During assembly and operation, the shutter housing 7, the first shutter member 15, the second shutter member 16, the third shutter member 17, the fourth shutter member 18, and the first and second springs 40 and 41 may each be formed separately. The first and second springs 40 and 41 are installed on protrusions 38 and 39 on the third and fourth shutter members 17 and 18, which are disposed within the shutter housing 7. The first spring 40 is disposed on the protrusion 39 on the fourth shutter member 18 and contacts a surface of the first stop member 8 above the first divider 13, and the second spring 41 is disposed on the protrusion 38 on the third shutter member 17 and contacts a surface of the first stop member 8 below the first divider 13. The third and fourth shutter member blocking ledges 27 and 28 contact a third stop member 42 and the first stop member 13, respectively. Next, the first and second shutter members 15 and 16 are located within the shutter housing 7, with the pivot shoulders 19 and 20 located within groove pairs 43 and 44 in the housing 7. When the first and second shutter members (upper shutter members) 15 and 16 are initially installed, they are in a relaxed state without the first and second spring members 40 and 41 providing reactive forces on the upper shutter members 15 and 16. When the upper shutter members 15 and 16 are rotated to the open position, each opposite lower shutter member (the third and fourth shutter members) 17 and 18 are slidingly or linearly moved against the extension force of the respective springs 40 and 41 to open the lower shutter members 17 and 18. When the lower shutters 17 and 18 are in the open position, a restoring force is provided by the springs 40 and 41, which slides the lower shutter members 17 and 18 to the closed position. Sliding the lower shutter members 17 and 18 to the closed position operates to move arms 33 and 34 of the lower shutter members 17 and 18 in the direction of the fingers 23 and 24 and contacts the rounded engagement portions 25 and 26, which forces the respective upper shutter members 15 and 16 to rotate to the closed position.

The tamper resistant shutter assembly 1 also includes the fifth, or perpendicular, shutter member 10 to limit access to the electrical contacts while still permitting a 20 amp electrical plug to be inserted within the electrical device 2. The fifth shutter member 10 includes a sloped outer surface 45 with a raised contact surface 46. The combination of the two surfaces 44 and 45 permits the perpendicular shutter member 10 to be located below the contact surface of the blocking ledge blocking surfaces 21 and 22 of the upper shutter members 15 and 16. Accordingly, the upper shutter members 15 and 16 are contacted and partially rotate, thereby sliding the respective lower shutter members 17 and 18 prior to the electrical plug contacting the perpendicular shutter member 10. When the lower shutter members 17 and 18 slide open, the locking ledge 37 is pulled out of locking aperture 47 of the perpendicular shutter member 10 to permit the perpendicular shutter member to move to the open position.

The perpendicular shutter member 10 is biased to the closed position with a spring member 48 mounted between a spring tab 49 on a rear portion 50 of the fifth shutter member 10 and the housing 57. The locking apertures 47 permit the perpendicular shutter member 10 to travel upwardly when contacting the locking ledge 37, while resisting downward movement (or movement in the opening direction). Thus, the perpendicular shutter member 10 can be moved to the closed position by the spring member 48 at any time against the locking ledge 37, but cannot be moved to the open position unless the locking ledge is removed from the locking aperture 47. Clearing the perpendicular shutter member 10 may occur before, after, or during movement of the upper and lower shutter members without departing from the spirit and scope of the disclosure.

Once all five shutter members 15, 16, 17, 18 and 10 and the spring members 40, 41 and 48 are installed, the shutter housing 7 is installed in a rear surface of the electrical device face 3 and mounting tabs 51 of the housing 7 engage the electrical device face 3 to mount the shutter housing 7. Accordingly, the tamper resistant shutter assembly 1 is self-contained within the shutter housing 7 and the electrical device face 3 and prevents unauthorized access to the electrical contacts located in line with the tamper resistant shutter assembly 1.

Second Exemplary Embodiment

A tamper resistant shutter assembly 101 in accordance with a second exemplary embodiment of the present invention is shown in FIGS. 8-15. The tamper resistant shutter assembly 101 substantially prevents access to the electrical terminals of an electrical device by unauthorized articles.

The tamper resistant shutter assembly 101 includes a housing 102, first and second upper shutters 103 and 104, third and fourth lower shutters 105 and 106, a fifth shutter 107, and first, second and third spring members 108-110.

Figure 12:
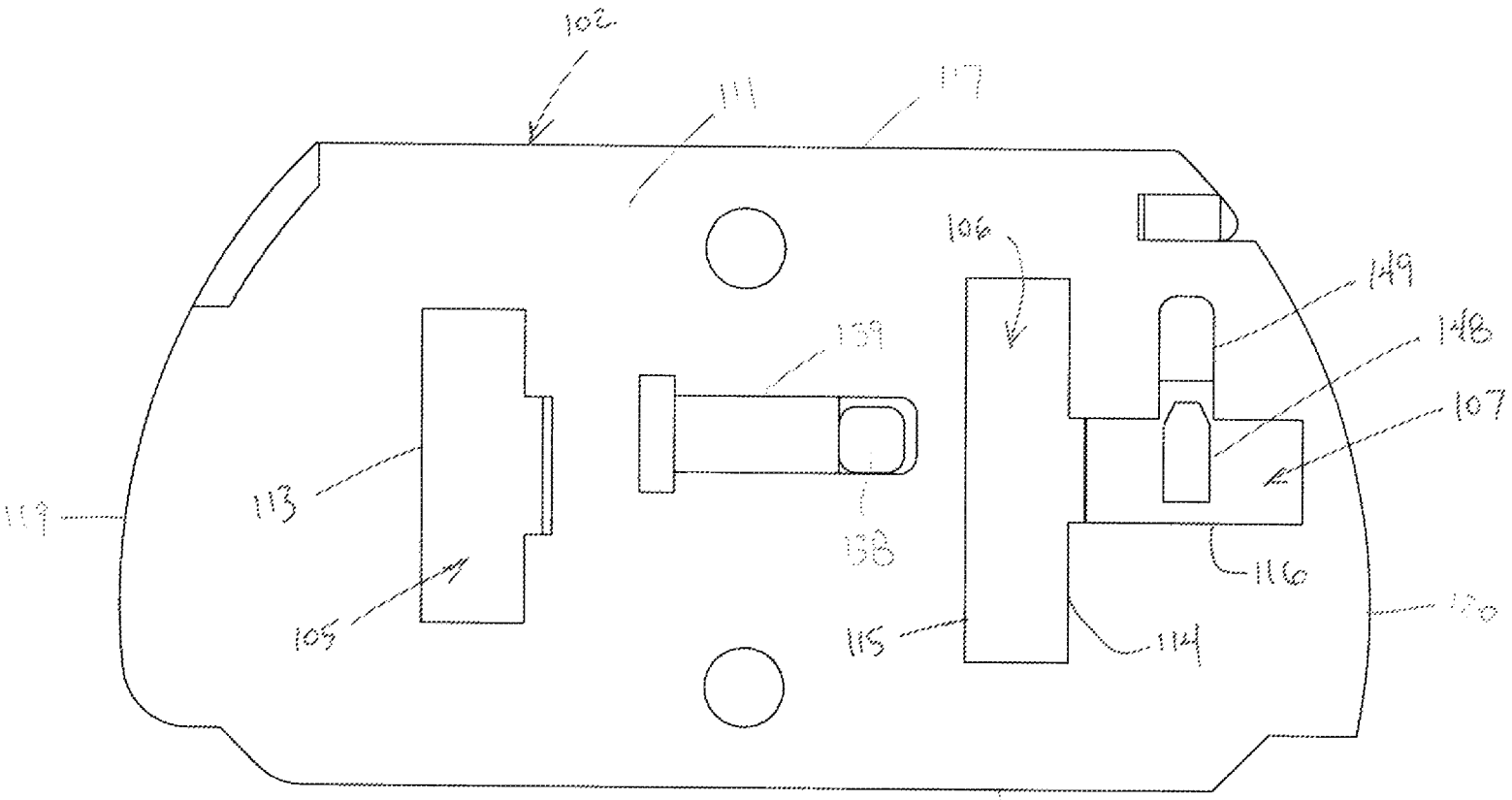
FIG. 12 is a rear elevational view of the tamper resistant assembly of FIG. 8 in the closed position.
Figure 13:
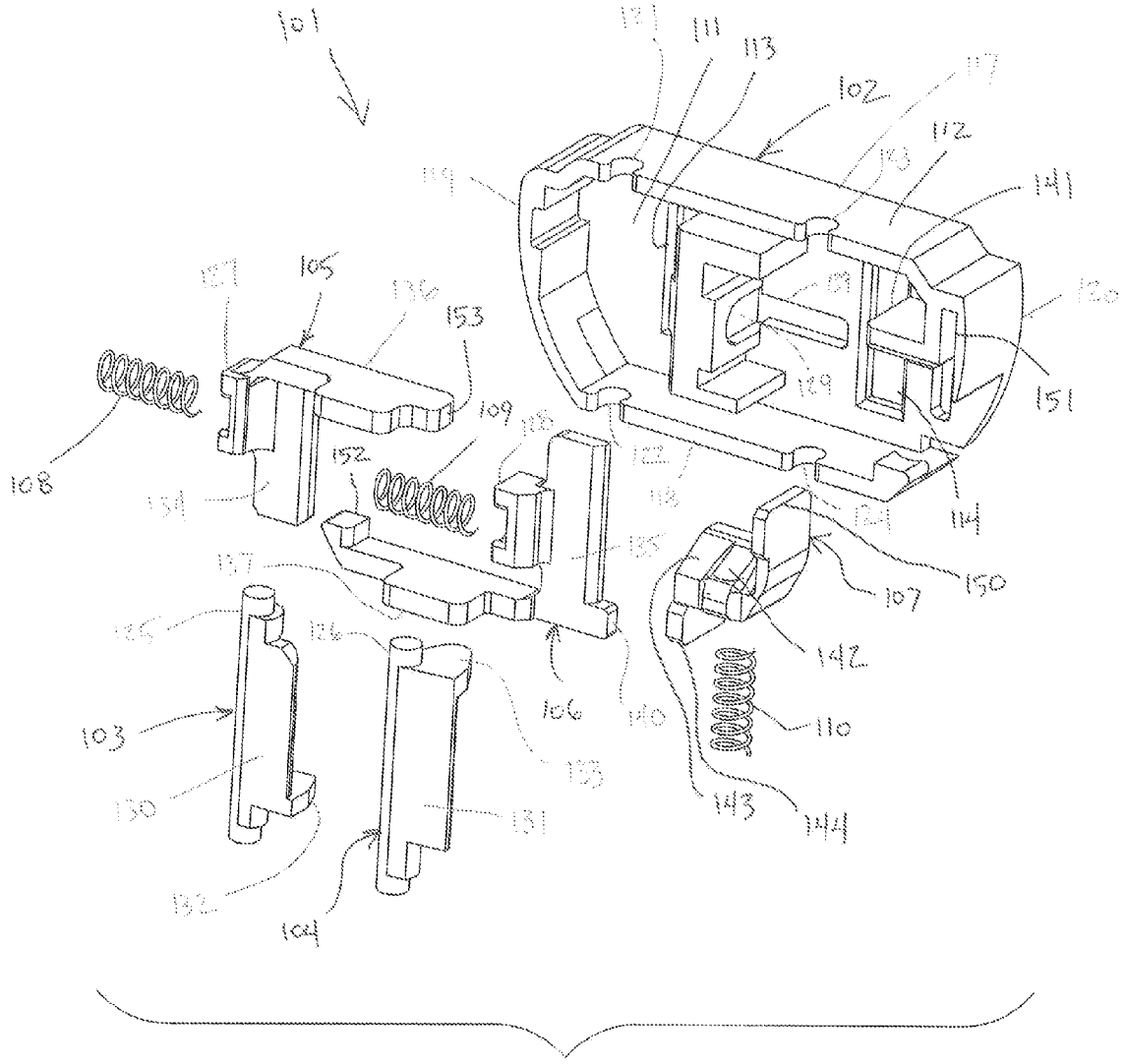
FIG. 13 is an exploded perspective view of the tamper resistant shutter assembly of FIG. 8.

The housing 102 has a base 111 and a wall 112 extending upwardly therefrom, as shown in FIG. 13. The base 111 has a first opening 113 and a second opening 114 disposed therein, as shown in FIGS. 12 and 13. The second opening 114 has a first portion 115 and a second portion 116 substantially perpendicular thereto. The first portion 115 of the second opening 114 is substantially parallel to the first opening 113. The second opening 114 is substantially T-shaped such that the tamper resistant shutter assembly 101 can be used with both 15 and 20 amp plugs. The wall 112 has a first pair of oppositely disposed walls 117 and 118 that are substantially parallel. A second pair of oppositely disposed side walls 119 and 120 are substantially arcuate to facilitate being received by bosses of a front face of a duplex receptacle. Preferably, the walls 119 and 120 curve away from the first pair of walls 117 and 118.

The tamper resistant shutter assembly 101 is disposable in an electrical device, such as the duplex electrical receptacle disclosed in U.S. Pat. No. 7,510,412 to Valentin, which is hereby incorporated by reference in its entirety. The electrical device (not shown) has a front face having a front surface with openings therein corresponding to the first and second openings 113 and 114 in the housing 102 of the tamper resistant shutter assembly 101. The plurality of openings in the electrical device extend through the front surface to permit blades 145 and 146 of an electrical plug 147 (FIG. 11) to engage electrical contacts disposed in the electrical device 2 (FIG. 1). The electrical contacts are aligned with the first and second openings 113 and 114 to ensure that the electrical plug blades can engage the electrical contacts during normal operation when the plurality of shutters are properly operated. The electrical contacts are generally protected from inadvertent engagement by the plurality of shutters when the shutters are improperly operated.

The first shutter member 103 is rotatably mounted within a first pair of grooves 121 and 122 in the first pair of oppositely disposed walls 117 and 118 of the housing 102, as shown in FIG. 13. The second shutter member 104 is rotatably mounted within a second pair of grooves 123 and 124 in the first pair of oppositely disposed walls 117 and 118 of the housing 102. The first pair of grooves 121 and 122 are disposed proximal the first arcuate wall 119, and the second pair of grooves 123 and 124 are disposed proximal the second arcuate wall 120. Each of the first and second shutter members 103 and 104 includes a pivot member 125 and 126 extending from each side of the shutter member. The pivot members 125 and 126 are received by the first and second pairs of grooves 121-124 to provide pivotal movement of the first and second shutter members 103 and 104 with minimal friction. The first and second shutter members 103 and 104 preferably pivot in the same direction, counter-clockwise as shown in FIG. 13, although the first and second shutter members can pivot in opposite directions.

Figure 8:
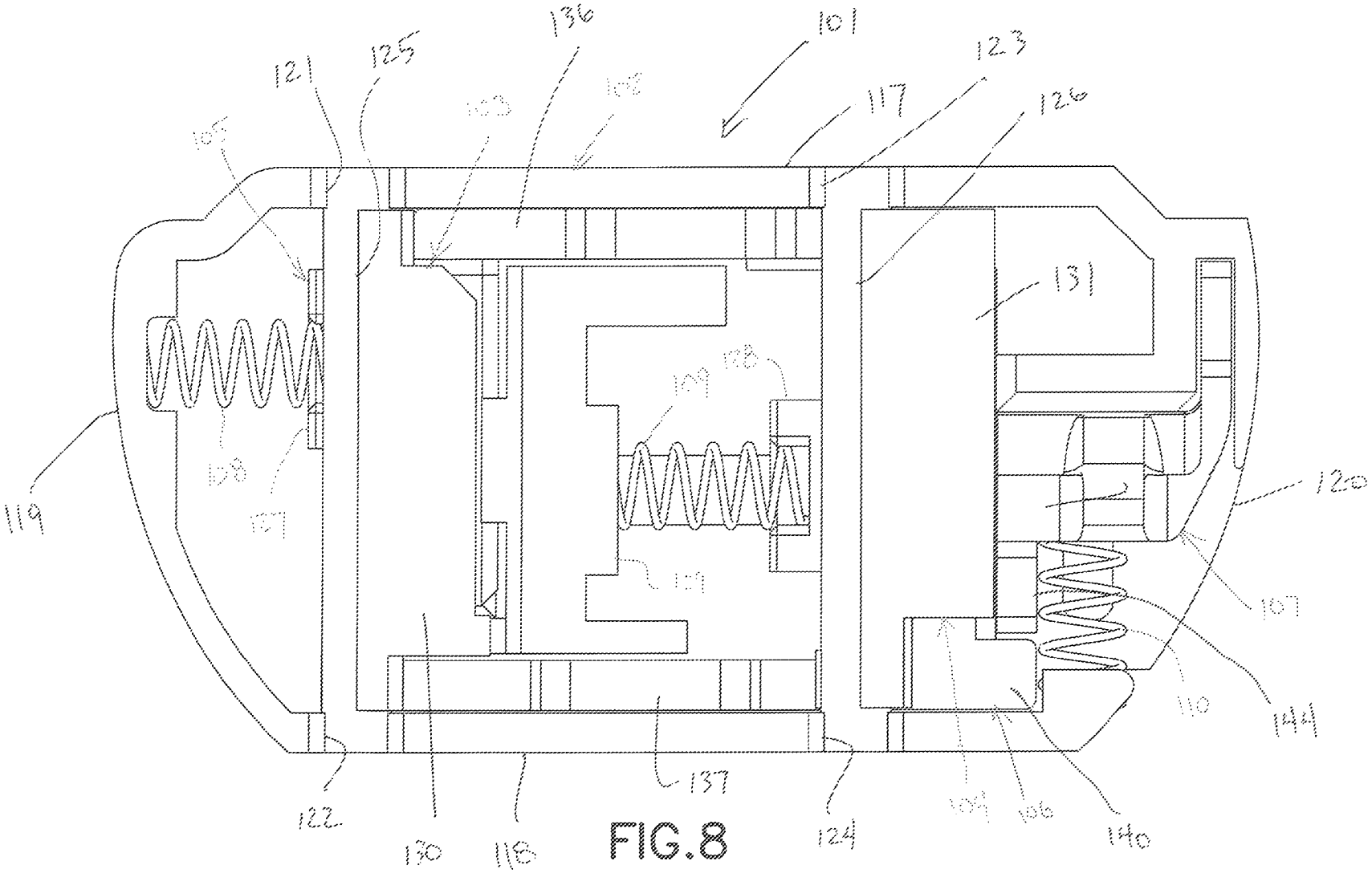
FIG. 8 is a top plan view of a tamper resistant shutter assembly in accordance with a second exemplary embodiment of the present invention in a closed position.
Figure 9:
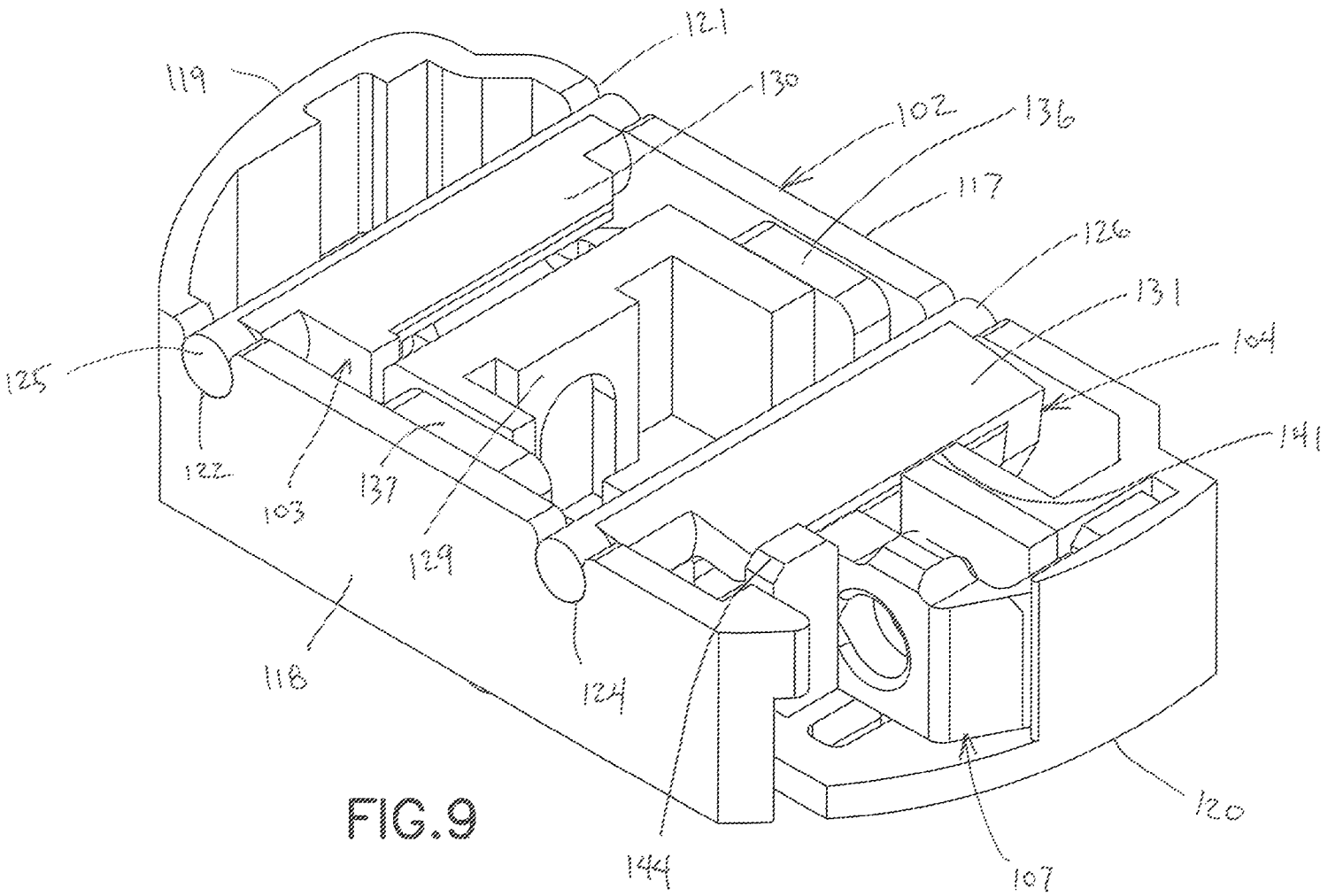
FIG. 9 is a perspective view of the tamper resistant shutter assembly of FIG. 8 without the spring members for clarity.
Figure 10:
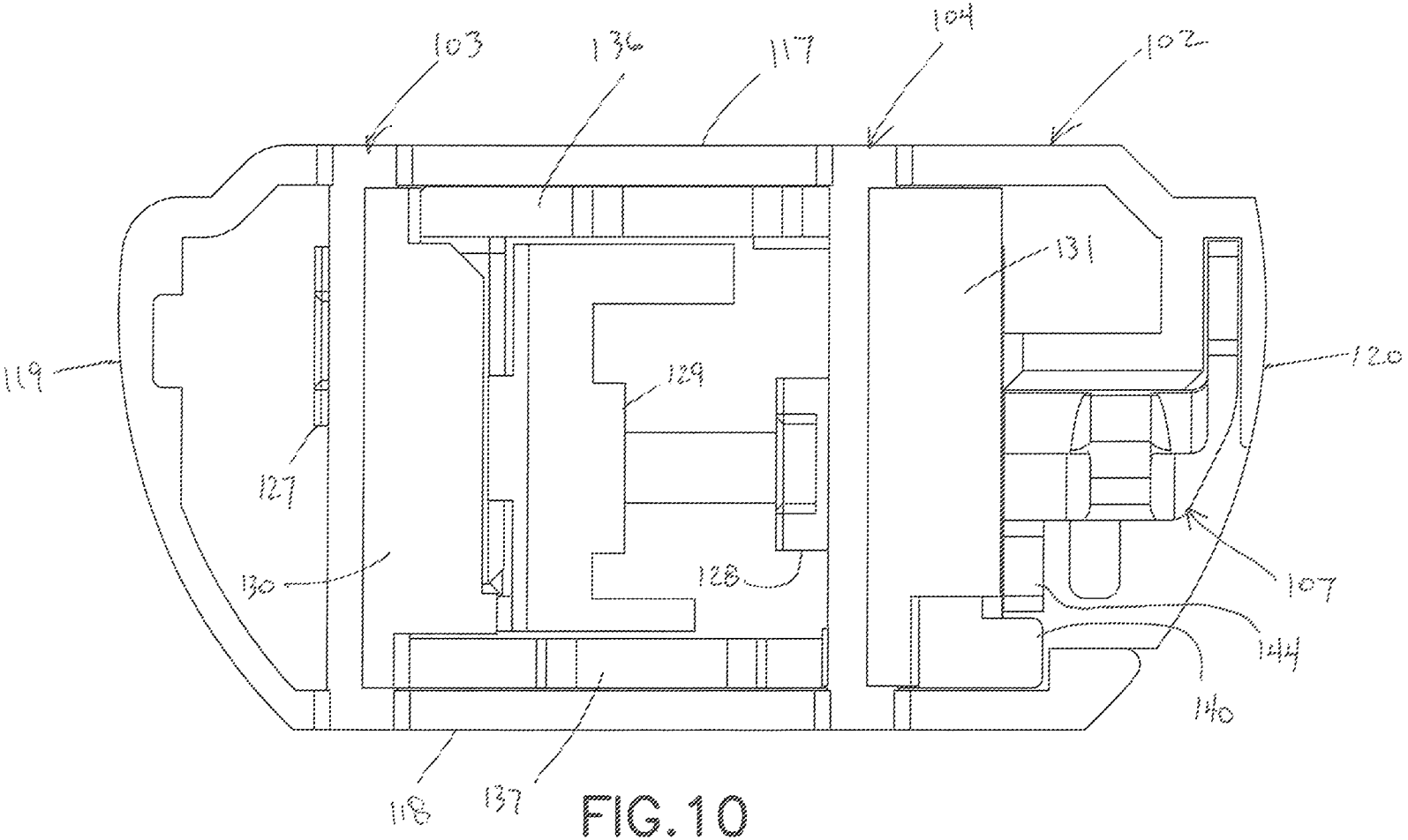
FIG. 10 is a top plan view of the tamper resistant shutter assembly of FIG. 9.
Figure 11:
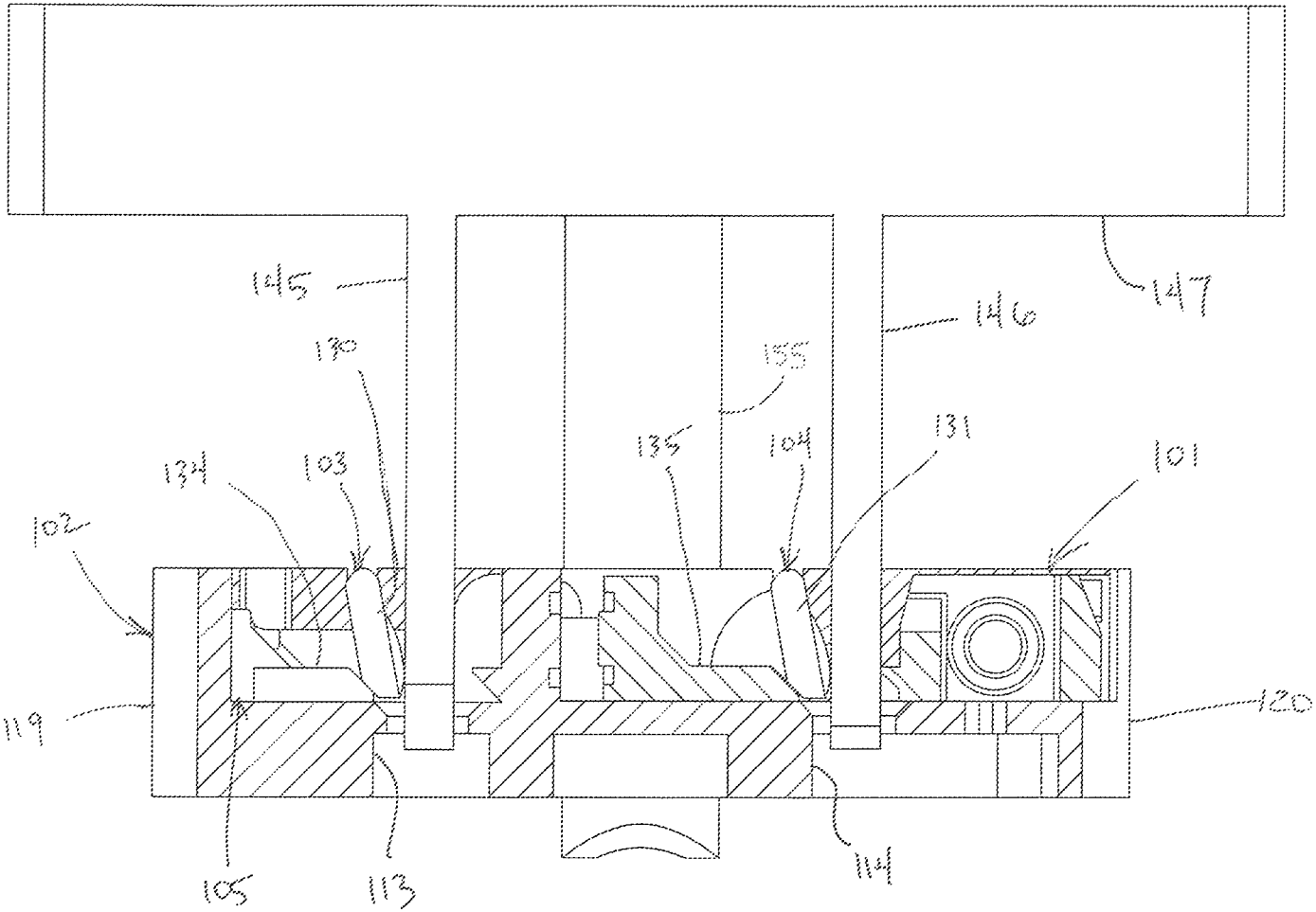
FIG. 11 is a front elevational view in partial cross section of the tamper resistant shutter assembly of FIG. 8 being moved to an open position by an inserted plug.
Figure 14:
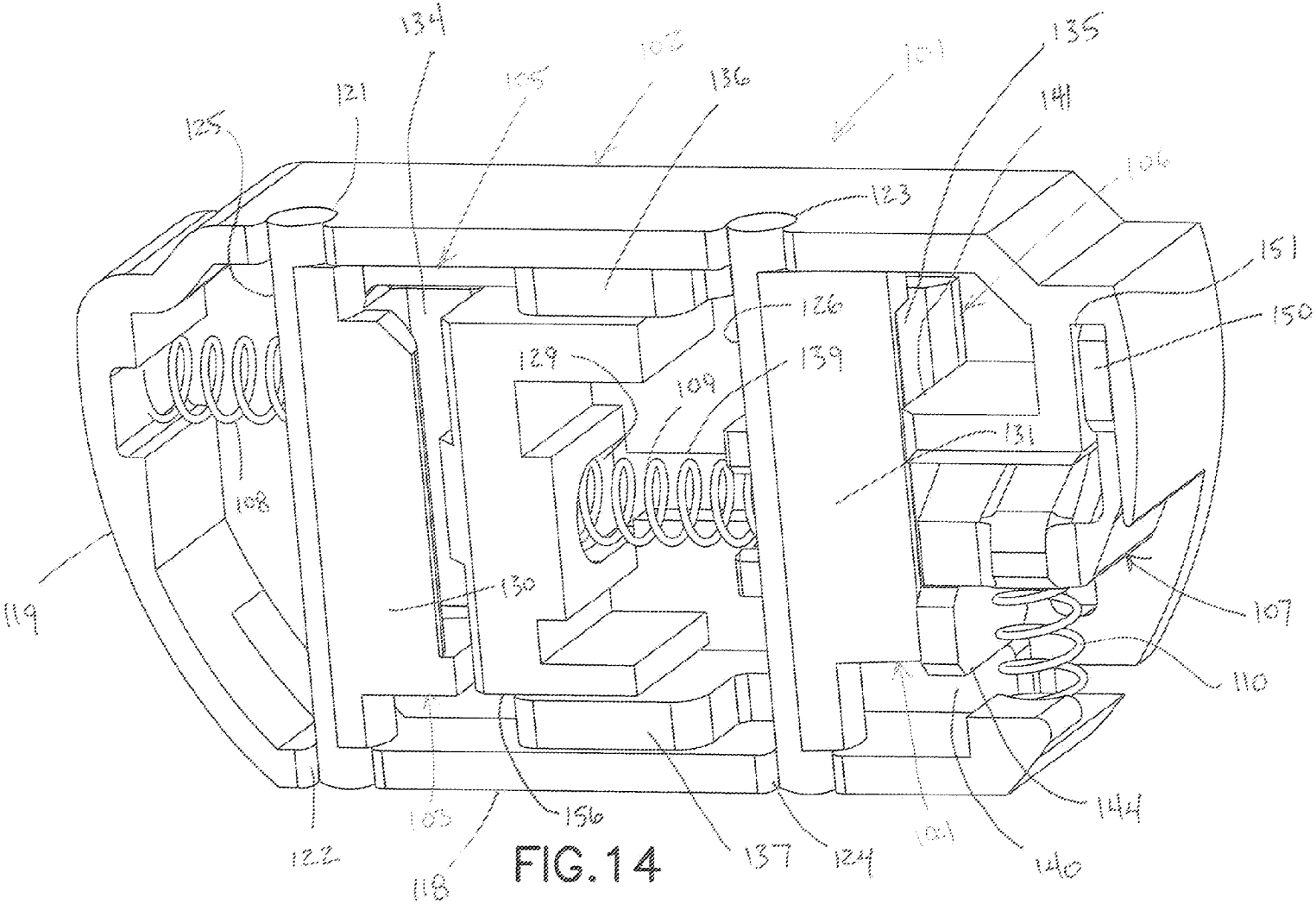
FIG. 14 is a perspective view of the tamper resistant shutter assembly of FIG. 8 in the closed position.

The third shutter member 105 is disposed behind the first shutter member 103 in the housing 102, and the fourth shutter member 106 is disposed behind the second shutter member 104, as shown in FIGS. 8, 11 and 14. Each of the third and fourth shutter members 105 and 106 has a spring mount 127 and 128 to receive first and second spring members 108 and 109. The first spring member 108 extends between the spring mount 127 of the third shutter member 105 and the first arcuate side wall 119. The second spring member 109 extends between the spring mount 128 of the fourth shutter member 106 and an inner wall 129 of the housing 102. The first and second spring members 108 and 109 are disposed on opposite sides of the housing inner wall 109. The first and second spring members 108 and 109 are shown as being compression or coil springs, although any suitable biasing member can be used.

The tamper resistant shutter assembly 101 includes four shutter members, with a first shutter member 103 and a second shutter member 104 acting as upper shutter members and a third shutter member 105 and a fourth shutter member 106 acting as lower shutter members. The first and second shutter members 103 and 104 pivot from the closed position to the open position about pivot members 125 and 126, respectively. The upper shutter members 103 and 104 preferably pivot in the same direction, and the lower shutter members 105 and 106 are preferably pushed/pulled in the same direction. The upper shutter member of one side operates the lower shutter member on the opposite side. For example, the first shutter member 103 operates the fourth shutter member 106, and the second shutter member 104 operates the third shutter member 105. Each of the upper shutter members 103 and 104 includes a blocking surface 130 and 131, and a cam member 132 and 133, respectively.

The lower shutter members 105 and 106 each include a blocking surface 134 and 135 and an arm 136 and 137 arranged to contact the respective upper shutter member 103 and 104 during opening and closing, as shown in FIG. 13. The fourth shutter member 106 may also include an alignment guide 138 received by a slot 139 in the base 111 of the housing 102 to guide the fourth shutter member during movement, as shown in FIG. 12. The fourth shutter member 106 includes a locking protrusion 140 extending outwardly from the blocking surface 135 that interacts with the fifth, or perpendicular, shutter member 107 as will be discussed in greater detail below. The lower shutter members 105 and 106 include the spring mounts 127 and 128 arranged to hold the spring members 108 and 109 to bias the lower shutter members 105 and 106 to the closed positions, thereby also biasing the upper shutter members 103 and 104 to the closed positions.

During assembly and operation, the shutter housing 102, the first shutter member 103, the second shutter member 104, the third shutter member 105, the fourth shutter member 106, and the first and second spring members 108 and 109 may each be formed separately. The first and second spring members 108 and 109 are received by the spring mounts 127 and 128 of the third and fourth shutter members 105 and 106, respectively, which are disposed within the shutter housing 102. The arm 136 of the third shutter member 105 is received between a lower surface 156 of the inner wall 129 and an inner surface of the lower wall 118, as shown in FIG. 14. The alignment guide 138 of the fourth shutter member 106 is received by the slot 139 in the housing 102, as shown in FIG. 12. The first spring member 108 is disposed between the spring mount 127 on the third shutter member 105 and an inner surface of the first arcuate side wall 119, as shown in FIGS. 13 and 14. The second spring member 109 is disposed between the spring mount 128 on the fourth shutter member 106 and the inner wall 129 of the housing 102.

The third and fourth shutter member blocking surfaces 134 and 135 contact the inner wall 129 of the housing 102 and a stop member 141 disposed in the housing 102, respectively. Next, the first and second shutter members 103 and 104 are located in the shutter housing 102, with the pivot members 125 and 126 received by the first and second pairs of grooves 121-124, respectively. When the first and second (upper) shutter members 103 and 104 are initially installed, they are in a relaxed state without the first and second spring members 108 and 109 providing reactive forces on the third and fourth (lower) shutter members 105 and 106. When the first and second shutter members 103 and 104 are pivoted to the open position, each opposite lower shutter member (the third and fourth shutter members) 105 and 106 are translationally or slidingly moved against the extension force of the respective spring members 108 and 109 to open the lower shutter members 105 and 106. When the lower shutters 105 and 106 are in the open position, a restoring force is provided by the spring members 108 and 109, which returns the lower shutter members 105 and 106 to the closed position. Sliding the lower shutter members 105 and 106 to the closed position operates to move arms 136 and 137 of the lower shutter members 105 and 106 to contact the cam members 132 and 133 of the first and second shutter members 103 and 104, thereby pivoting the respective first and second shutter members 103 and 104 to the closed position.

Figure 15:
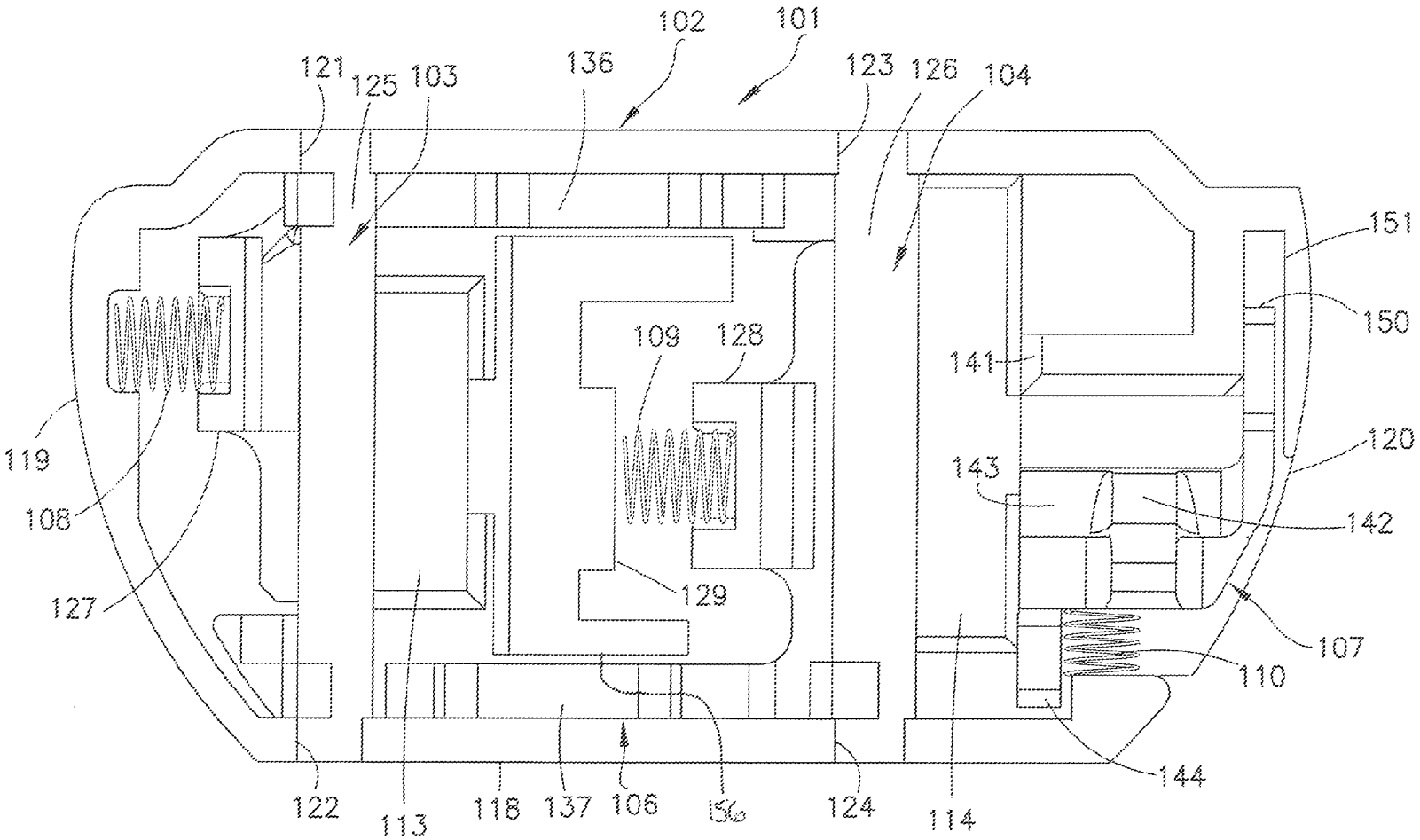
FIG. 15 is a top plan view of the tamper resistant shutter assembly of FIG. 8 in the open position.

The tamper resistant shutter assembly 101 also includes the fifth, or perpendicular, shutter member 107 to limit access to the electrical contacts while still permitting a 20 amp electrical plug to be inserted within the electrical device. The fifth shutter member 107 includes a sloped outer surface 142 with a raised contact surface 143. The first and second shutter members 103 and 104 are contacted and partially pivot, thereby sliding the respective third and fourth shutter members 105 and 106 prior to the electrical plug contacting the perpendicular shutter member 107. When the third and fourth shutter members 105 and 106 slide open, the locking protrusion 140 is pulled out from beneath a locking member 144 of the perpendicular shutter member 107 to permit the perpendicular shutter member to move downwardly to the open position, as shown in FIG. 15. An alignment guide 148 connected to the fifth shutter member 107 is received by a slot 149 in the base 111 of the housing 102 to guide movement between closed and open positions, as shown in FIG. 12. An arm 150 of the fifth shutter member 107 is received by a recess 151 to further guide movement thereof, as shown in FIGS. 14 and 15.

The perpendicular shutter member 107 is biased to the closed position with the third spring member 110 mounted between the fifth shutter member 107 and the wall 118 of the housing 102. The locking protrusion 140 prevents downward movement of the fifth shutter member 107 to the open position by engaging and preventing downward movement of the locking member 144. The fifth shutter member 107 is biased to the closed position by the third spring member 110 and engages the stop member 141 to prevent further upward movement. The fifth shutter member 10 is movable to the open position when the locking protrusion 140 of the fourth shutter member 106 is moved out of engagement with the locking member 144. Clearing the fifth shutter member 107 may occur before, after, or during movement of the upper and lower shutter members without departing from the spirit and scope of the disclosure.

Once all five shutter members 103-107 and the three spring members 108-110 are installed, the shutter housing 102 is installed in a rear surface of the electrical device face. Accordingly, the tamper resistant shutter assembly 101 is self-contained within the shutter housing 102 and the electrical device face and prevents unauthorized access to the electrical contacts located in line with the tamper resistant shutter assembly 101.

In a normal, operating condition, the blocking surfaces 130 and 131 of the first and second shutter members 103 and 104 are disposed beneath the receptacle openings. Inserting a foreign object into the left-side receptacle opening causes the foreign object to strike the blocking surface 130 of the first shutter member 103, which pivots to an open position. As the first shutter member 103 pivots to the open position, the cam surface 132 engages a protrusion 152 of the arm 137 of the fourth shutter member 106 to move the fourth shutter member from the closed to the open position. The third shutter member 105 does not move, such that the foreign object strikes the blocking surface 134 of the third shutter member 105 and is prevented from passing through the opening 113 to engage the electrical contact disposed in the body of the receptacle. When the foreign object is removed from the receptacle opening, the second spring member 109 moves the fourth shutter member 106 back to the closed position. The protrusion 152 of the arm 137 engages the cam surface 132 of the first shutter member 103 to pivot the first shutter member back to the closed position.

Similarly, inserting a foreign object into the right-side receptacle opening causes the foreign object to strike the blocking surface 131 of the second shutter member 104, which pivots to an open position. As the second shutter member 104 pivots to the open position, the cam surface 133 engages an end 153 of the arm 136 of the third shutter member 105 to move the third shutter member from the closed to the open position. The fourth shutter member 106 beneath the second shutter member 104 does not move, such that the foreign object strikes the blocking surface 135 of the fourth shutter member 106 and is prevented from passing through the opening 114 to engage the electrical contact disposed in the body of the receptacle. When the foreign object is removed from the receptacle opening, the first spring member 108 moves the third shutter member 105 back to the closed position. The end 153 of the arm 137 engages the cam surface 133 of the second shutter member 104 to pivot the second shutter member back to the closed position.

A plug 147 being properly inserted in the tamper resistant shutter assembly 101 is shown in FIG. 11. The first plug blade 145 engages the blocking surface 130 of the first shutter member 103 and pivots the first shutter member. The cam surface 132 of the first shutter member 103 engages the protrusion 152 of the arm 137 of the fourth shutter member 106, such that the fourth shutter member is moved against the biasing force of the second spring member 109. The fourth shutter member 106 is moved to the open position, thereby providing access to the second opening 114 in the housing 102. The second plug blade 146 engages the blocking surface 131 of the second shutter member 104 and pivots the second shutter member. The cam surface 133 of the second shutter member 104 engages the end 153 of the arm 136 of the third shutter member 105, such that the third shutter member is moved against the biasing force of the first spring member 108. The third shutter member 105 is moved to the open position, thereby providing access to the first opening 113 in the housing 102. Accordingly, the first and second plug blades 145 and 146 are permitted to pass through the housing openings 113 and 114, as shown in FIG. 11, to access the electrical contacts disposed in the receptacle body. A ground prong 155 of the plug 147 is preferably not received by the housing 102, as shown in FIG. 11.

When the plug blades 145 and 146 are removed from the tamper resistant shutter assembly 101, the biasing force of the first and second spring members 108 and 109 move the third and fourth shutter members 105 and 106 back to the closed positions to recover the housing openings 113 and 114. As the third shutter member 105 moves back to the closed position, the end 153 of the arm 136 engages the cam surface 133 of the second shutter member 104 to pivot the second shutter member back to the closed position. As the fourth shutter member 106 moves back to the closed position, the protrusion 152 of the arm 137 engages the cam surface 132 of the first shutter member to pivot the first shutter member back to the closed position. The blocking surface 134 of the third shutter member 105 engages the inner wall 129 of the housing 102 to stop movement of the third shutter member in the return direction. The blocking surface 135 of the fourth shutter member 106 engages the stop member 141 to stop movement of the fourth shutter member 106 in the return direction. Movement of the third shutter member 105 is guided by the arm 136 received between the lower surface 156 of the inner wall 129 and the inner surface of the lower wall 118, as shown in FIGS. 14 and 15. Movement of the fourth shutter member 106 is guided by the alignment guide 138 received in the slot 139 in the base 111 of the housing 102.

A 20 amp plug has a blade that is substantially perpendicular to the second blade 146 and is received by the second portion 116 of the second opening 114 in the base 111 of the housing 102, as shown in FIG. 12. The perpendicular plug blade strikes the raised surface 143 of the fifth shutter member 107 to move the fifth shutter member downwardly. The locking protrusion 140 of the fourth shutter member 106 is disposed beneath the locking member 144 of the fifth shutter member 107, thereby preventing downward movement of the fifth shutter member until the fourth shutter member 106 is moved to the open position. As described above, the first plug blade 145 pivots the first shutter member 103, thereby moving the fourth shutter member 106 to the open position. When the fourth shutter member 106 is in the open position, the locking protrusion 140 is not disposed beneath the locking member 144, as shown in FIG. 15. The perpendicular plug blade can then move the fifth shutter member 107 downwardly against the third spring member 110 to uncover the second portion 116 of the second opening 114, thereby providing access to the electrical contacts in the body of the electrical receptacle.

When the plug blades are removed, the third spring member 110 returns the fifth shutter member 107 to the closed position. The fifth shutter member 107 engages the stop member 141 to prevent further upward movement thereof. Upward movement of the fifth shutter member 107 is also stopped by the arm 150 engaging the end of the recess 151 in the housing 102. Movement of the fifth shutter member 107 is guided by the alignment guide 148 received in the slot 149 in the base 111 of the housing 102.

The foregoing embodiments and advantages are merely exemplary and are not to be construed as limiting the scope of the present invention. The description of exemplary embodiments of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A tamper resistant shutter assembly for an electrical device, comprising:

a housing having oppositely disposed first and second arcuate walls to facilitate being disposed in the electrical device;

a first shutter member movably disposed in said housing between closed and open positions;

a second shutter member movably disposed in said housing between closed and open positions;

a third shutter member movably disposed in said housing between closed and open positions, said third shutter member being movable from said closed position to said open position by movement of said second shutter member from said closed position to said open position;

a fourth shutter member movably disposed in said housing between closed and open positions, said fourth shutter member being movable from said closed position to said open position by movement of said first shutter member from said closed position to said open position; and a fifth shutter member movably disposed in said housing between closed and open positions, said fifth shutter member being prevented from moving from said closed position to said open position when said fourth shutter member is in said closed position.

2. The tamper resistant shutter assembly for an electrical device according to claim 1, wherein said electrical device is a 20 amp electrical receptacle.

3. The tamper resistant shutter assembly for an electrical device according to claim 1, wherein said first shutter member is disposed between a face of said electrical device and said third shutter member, and said second shutter member is disposed between said face of said electrical device and said fourth shutter member.

4. The tamper resistant shutter assembly for an electrical device according to claim 1, wherein said first and second shutter members are pivotally disposed in said housing.

5. The tamper resistant shutter assembly for an electrical device according to claim 1, wherein said third and fourth shutter members move translationally in said housing.

6. The tamper resistant shutter assembly for an electrical device according to claim 4, wherein said first and second shutter members pivot in the same direction from said closed to open positions.

7. The tamper resistant shutter assembly for an electrical device according to claim 5, wherein said third and fourth shutter members move in the same direction from said closed to open positions.

8. The tamper resistant shutter assembly for an electrical device according to claim 5 wherein said fifth shutter member moves translationally in said housing.

9. The tamper resistant shutter assembly for an electrical device according to claim 8, wherein said fifth shutter member moves substantially perpendicularly to said third and fourth shutter members.

10. The tamper resistant shutter assembly for an electrical device according to claim 1, wherein said first arcuate wall curves away from said second arcuate wall.

11. The tamper resistant shutter assembly for an electrical device according to claim 1, wherein a first biasing member biases said third shutter member to said closed position, and a second biasing member biases said fourth shutter member to said closed position.

12. The tamper resistant shutter assembly for an electrical device according to claim 11, wherein a third biasing member biases said fifth shutter member to said closed position.

13. The tamper resistant shutter assembly for an electrical device according to claim 1, wherein said first and second biasing members are disposed on opposite sides of said first shutter member.

14. The tamper resistant shutter assembly for an electrical device according to claim 13, wherein said first biasing member is disposed between an outer wall of said housing and said third shutter member and said second biasing member is disposed between an inner wall of said housing and said fourth shutter member.

15. The tamper resistant shutter assembly for an electrical device according to claim 12, wherein said third biasing member is disposed substantially perpendicularly with respect to said first and second biasing members.

16. The tamper resistant shutter assembly for an electrical device according to claim 1, wherein a tab of said fourth shutter member engages an outer edge of said fifth shutter member when said third and fifth shutter members are in said closed positions, thereby preventing movement of said fifth shutter member.

17. A tamper resistant assembly for an electrical device, comprising:

a housing having oppositely disposed first and second arcuate walls to facilitate being disposed in the electrical device;

a first shutter member pivotally disposed in said housing between closed and open positions;

a second shutter member pivotally disposed in said housing between closed and open positions;

a third shutter member slidably disposed in said housing between closed and open positions, said third shutter member being slid from said closed position to said open position by pivotal movement of said second shutter member from said closed position to said open position;

a first biasing member biasing said third shutter member to said closed position;

a fourth shutter member slidably disposed in said housing between closed and open positions, said fourth shutter member being slid from said closed position to said open position by pivotal movement of said first shutter member from said closed position to said open position;

a second biasing member biasing said fourth shutter member to said closed position, said first and second biasing members are disposed on opposite sides of said first shutter member;

a fifth shutter member slidably disposed in said housing between closed and open positions, said fifth shutter member being prevented from moving from said closed position to said open position when said fourth shutter member is in said closed position; and a third biasing member biasing said fifth shutter member to said closed position.

18. The tamper resistant shutter assembly for an electrical device according to claim 17, wherein said first shutter member is disposed between a face of said electrical device and said third shutter member, and said second shutter member is disposed between said face of said electrical device and said fourth shutter member.

19. The tamper resistant shutter assembly for an electrical device according to claim 17, wherein said electrical device is a 20 amp electrical receptacle.

20. The tamper resistant shutter assembly for an electrical device according to claim 17, wherein said first and second shutter members pivot in the same direction from said closed to open positions, and said third and fourth shutter members slide in the same direction from said closed to open positions.

* * * * *